US006839998B1

(12) United States Patent
Armstrong

(10) Patent No.: US 6,839,998 B1
(45) Date of Patent: Jan. 11, 2005

(54) REPLACEMENT CHASSIS STOCK SYSTEM FOR FIREARMS

(75) Inventor: David P. Armstrong, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/631,216

(22) Filed: Jul. 31, 2003

(51) Int. Cl.[7] ..... F41C 23/00

(52) U.S. Cl. ..... 42/71.01; 42/73; 42/72; 42/75.03

(58) Field of Search ..... 42/71.01, 73, 72, 42/75.03

(56) References Cited

U.S. PATENT DOCUMENTS

| | | | | | |
|---|---|---|---|---|---|
| 3,611,607 | A | * | 10/1971 | Donnell | 42/106 |
| 3,830,003 | A | | 8/1974 | Clerke | 42/75 |
| 4,663,876 | A | * | 5/1987 | Reaume | 42/71.01 |
| 5,343,650 | A | | 9/1994 | Swan | 42/100 |
| 5,412,895 | A | | 5/1995 | Krieger | 42/75.02 |
| 5,711,102 | A | | 1/1998 | Plaster et al. | 42/71.01 |
| 5,933,997 | A | * | 8/1999 | Barrett | 42/73 |
| 5,970,642 | A | | 10/1999 | Martin | 42/73 |
| 6,314,672 | B2 | | 11/2001 | Murello et al. | 42/75.02 |
| 6,374,528 | B1 | * | 4/2002 | Davis et al. | 42/71.01 |
| 6,490,822 | B1 | | 12/2002 | Swan | 42/71.01 |
| 6,499,245 | B1 | | 12/2002 | Swan | 42/71.01 |
| 6,651,371 | B2 | * | 11/2003 | Fitzpatrick et al. | 42/72 |
| 2002/0050088 | A1 | | 5/2002 | Sharp | 42/73 |

* cited by examiner

*Primary Examiner*—J. Woodrow Eldred
(74) *Attorney, Agent, or Firm*—Mark Homer

(57) ABSTRACT

Disclosed herein is a modular, replacement chassis stock system for an existing firearm's operating mechanism possessing a simple design and incorporating durable, commercially available components. The system comprises a chassis assembly with up to three integral mounting rails, a top rail, a replacement operating rod guide, a telescoping buttstock assembly, and a buttstock/grip mount assembly. The present invention may be used to replace the standard stock of an M-14 rifle (or copies thereof, such as the Springfield Armory M1A) such that the barrel is held in perfect alignment with up to five Mil Std 1913 pattern mounting rails. The telescoping buttstock assembly is adjustable in length via the use of a thumb lever release and includes an adjustable cheek-rest, an optionally adjustable buttpad, and a pistol grip. Auxiliary devices may be attached to the chassis stock system via the buttstock/grip mount assembly located above the pistol grip. The chassis stock system is secured at the rear of the barreled action by the installation of the trigger assembly and at the front by attaching it to the replacement operating rod guide.

19 Claims, 10 Drawing Sheets

REPLACEMENT CHASSIS STOCK SYSTEM FOR FIREARMS

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention relates to firearms and, more particularly, to the stock/chassis components of firearms and, even more particularly, to a replacement chassis stock system for use with a firearm (e.g. an M-14 rifle) to improve its shooting accuracy, to enhance its ergonomics, and to supplement its functionality.

2. Description of the Background

The technology of firearms is advancing, and it can be very beneficial to incorporate technological advances to improve shooting accuracy, ergonomics, and/or overall functionality. Indeed, the original design of a weapon system often requires updating in order to prolong its useful life. Of course, it is always more economical to update the design of an existing firearm, as opposed to developing a completely new weapon system. This is especially true when many thousands of units already exist, and a retrofit solution can offer significant cost savings to any organization possessing a large number of those firearms in its inventory.

The present inventor is not the first to pose a solution for improving the accuracy, ergonomics, and/or functionality of an existing firearm design. For example, a device for improving an existing firearm's accuracy is found in U.S. Pat. No. 5,412,895 to Krieger, a device for improving an existing firearm's ergonomics are found in U.S. Pat. Nos. 5,970,642 to Martin and 5,711,102 to Paster et al., and a device for improving an existing firearm's functionality are found in U.S. Pat. Nos. 6,499,245, 6,490,822, and 5,343,650 to Swan.

More specifically, U.S. Pat. No. 5,412,895 to Krieger discloses a floating gun barrel mount having the barrel free to remain straight and free of deflection by the sling because it is not attached to the forearm, and a two piece barrel nut to allow universal alignment of gas tube openings. The two-piece barrel nut allows for mass production of the barrel nut, allows alignment for any rotational position of the threads on the barrel receiver, and still provides the high amount of pressure required to secure the barrel firmly to the receiver.

U.S. Pat. No. 5,970,642 to Martin discloses an ergonomic adjustable gun stock having an elongate forearm portion with a longitudinal concave receiver channel in its upper surface for receiving the barrel of a gun, a butt portion extending rearwardly from the forearm portion, a vertically adjustable cheek piece, a longitudinally adjustable and removable auxiliary hand gripping element on the underside of the butt portion, and an adjustable recoil butt pad assembly mounted on the rear end of the butt portion. The cheek piece is an inverted generally U-shaped member having a rounded top surface and contiguous laterally spaced parallel sides. The butt portion has a cheek piece receiving recess sized and shaped to slidably receive the cheek piece in a lowermost position, such that the outer periphery of the cheek piece is generally flush with the outer periphery of the butt portion in its lowermost position.

U.S. Pat. No. 5,711,102 to Plaster et al. discloses an integral user configurable sniper rifle stock comprising a wide forearm and a relatively narrow carry portion extending rearwardly from the forearm. An action mounting portion extends rearwardly from the carry portion. An angled relatively vertical, stippled grip extends rearwardly and downwardly from the receiver portion. An open rear stock portion extends rearwardly from the grip. The rear stock portion comprises upper and lower braces with a butt extending vertically between rear extents of the braces. The upper brace receives a mounting screw for a displaceable, interchangeable cheek piece disposed about the upper brace. A vertically displaceable butt plate/pad and spacers are mounted to the butt. The spacers are used to adjust the length of pull of the rifle.

U.S. Pat. Nos. 6,499,245 and 6,490,822 to Swan disclose a universal receiver sleeve attached to the top of a firearm upper receiver and extended forward above the firearm barrel to a position just short of the firearm front sight. The underside of the rear portion of the sleeve is fixedly attached to the receiver top. The underside of the forward portion of the sleeve has an upper handguard piece attached thereto. A bottom handguard piece is fitted about the bottom of the gun barrel and is attached to the upper handguard piece. The handguard pieces are not physically connected in any way to the gun barrel. The sleeve is self-supported by the connection of the rear portion underside to the receiver top. U.S. Pat. No. 6,499,245 further discloses a special yoke inserted about the barrel nut of the firearm to which the modular sleeve is attached. The special yoke reinforces the modular sleeve while keeping the firearm barrel free floating.

U.S. Pat. No. 5,343,650 to Swan discloses an extended rigid interface frame with upper and lower rails joined to a firearm receiver and extending forward above the firearm's barrel to a head assembly replacing the firearm's normal front sight. A weaver type interface return portion is provided below the barrel from the head assembly to the receiver. A yoke braces the extended rigid frame receiver sleeve of the present invention to the forward portion of the firearm's receiver. The distal end of the extended rigid frame receiver sleeve terminates in the front sight housing that connects the upper and lower rails, thereby providing a housing for advanced laser and sensor components and the standard front sight bead. The front sight housing is self supported by the connection of the upper and lower rails running back to the yoke and secured to the top of the receiver. The barrel of the rifle is free floating in that it does not touch the extended rigid frame receiver sleeve in any manner.

Thus, while a variety of different means for improving the accuracy, ergonomics, and/or functionality of an existing firearm design are known, none of the foregoing devices improve the shooting accuracy of an existing firearm by facilitating the free float of a significant portion of the front end of the barrel and gas system, and enhance the ergonomics via multiple dimensional adjustments of its user interface. Moreover, the above-described devices do not hold the mounting bracket(s) or rails in alignment with the barrel's bore axis and, therefore, lack the ability to maintain proper alignment of any auxiliary devices mounted thereon. Consequently, it would be greatly advantageous to provide a replacement chassis stock system for a rifle that (1) improves the shooting accuracy of an existing firearm by introducing a novel mounting apparatus for the barrel and gas system that facilitates the free float of a significant portion of their front ends, (2) enhances its ergonomics via a fully adjustable buttstock assembly, and (3) supplements its functionality by holding its barrel in alignment with up to five Mil Std 1913 pattern mounting rails.

SUMMARY OF THE INVENTION

It is, therefore, the primary object of the present invention to provide a replacement chassis stock system that prolongs the useful life of an existing firearm design by retrofit modification.

It is another object of the present invention to provide a replacement chassis stock system that improves the firearm's shooting accuracy by mounting its barrel and gas system in a manner that allows a significant portion of their front ends to float freely.

Still another object of the present invention is to provide a replacement chassis stock system that enhances the ergonomics of the firearm's user interface via a fully adjustable buttstock assembly.

It is still another object of the present invention to provide a replacement chassis stock system that supplements an existing firearm's functionality by holding its barrel in perfect alignment with up to five Mil Std 1913 pattern mounting rails.

Yet another object of the present invention is to provide a replacement chassis stock system that possesses a simple design incorporating durable, commercially available components and materials that may be economically produced to provide for widespread use.

These and other objects are accomplished by a modular, replacement chassis stock system for an existing firearm's operating mechanism (i.e. barreled action, trigger assembly) possessing a simple design, incorporating durable, commercially available components and materials, that may be economically produced to provide for widespread use. The system typically comprises a chassis assembly, a top rail, a replacement operating rod guide, a telescoping buttstock assembly, and a buttstock/grip mount assembly. A preferred embodiment of the present invention may be used to replace the standard stock of an M-14 rifle such that the barrel is held in perfect alignment with up to five Mil Std 1913 pattern mounting rails. The chassis stock system is secured at the rear of the barreled action by the installation of the trigger assembly and at the front by attaching it to the replacement operating rod guide.

The chassis assembly includes up to three mounting rails fixedly attached to a chassis that is preferably fabricated from a single block of aluminum or another rigid material. If a fourth rail is required/desired, it is generally part of the top rail. The replacement operating rod guide replaces the standard operating rod guide and must be installed on the existing barreled action before the overall firearm may be assembled. The barrel and associated gas system remain free floating from the replacement operating rod guide forward. The telescoping buttstock assembly is adjustable in length via the use of a thumb lever release and includes an adjustable cheek-rest, a buttpad (optionally adjustable), and a pistol grip. Additional auxiliary devices may be attached to the chassis stock system via the integral rail section (i.e. a fifth Mil Std 1913 rail) atop the buttstock/grip mount assembly.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
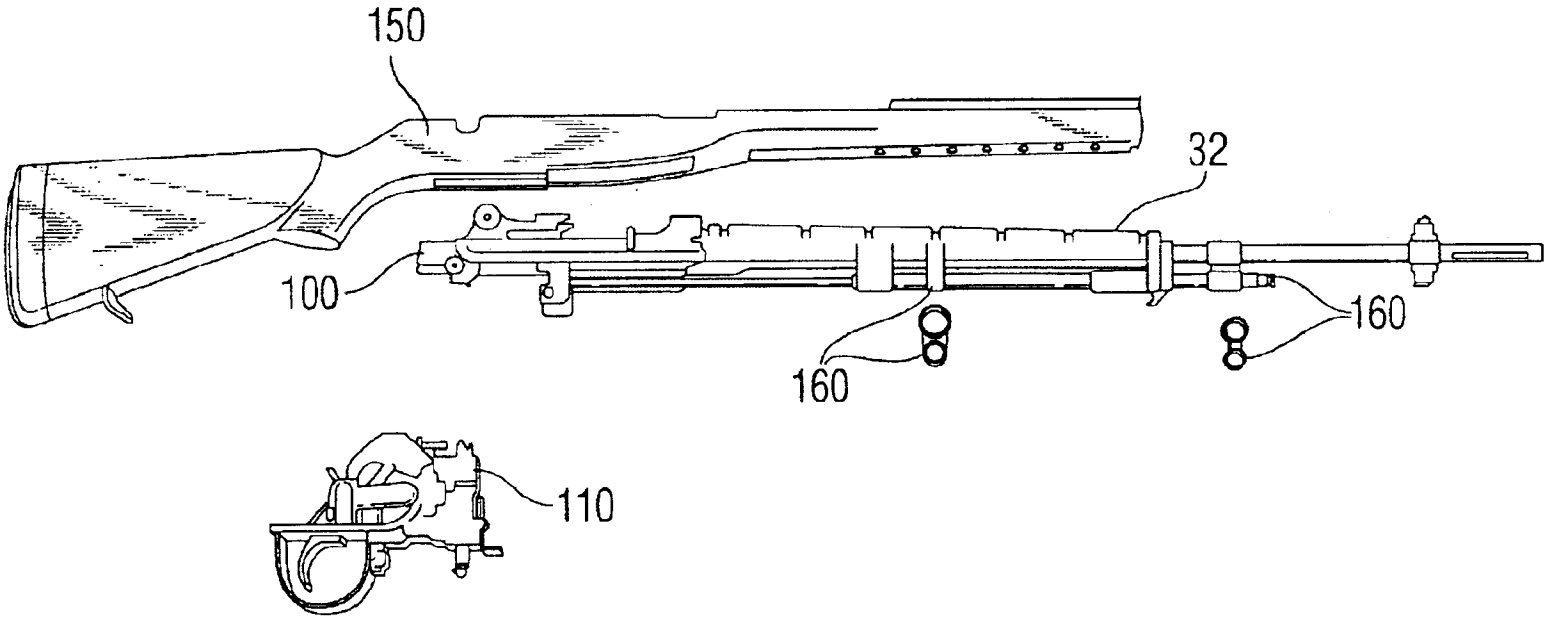
Fig. 1 (Prior Art)
FIG. 1 is a side exploded view of a standard M-14 rifle configuration inclusive of the barreled action 100, standard stock 150, top handguard 32, operating rod guide 160, and trigger assembly 110 from the existing firearm design.

FIG. 1 is a side exploded view of a standard M-14 rifle assembly inclusive of the barreled action 100, standard stock 150, operating rod guide 160, top handguard 32, and trigger assembly 110 from the existing firearm design. Components 32, 150, and 160 are typically replaced for installation of the replacement chassis stock system 10 of the present invention.

Figure 2:
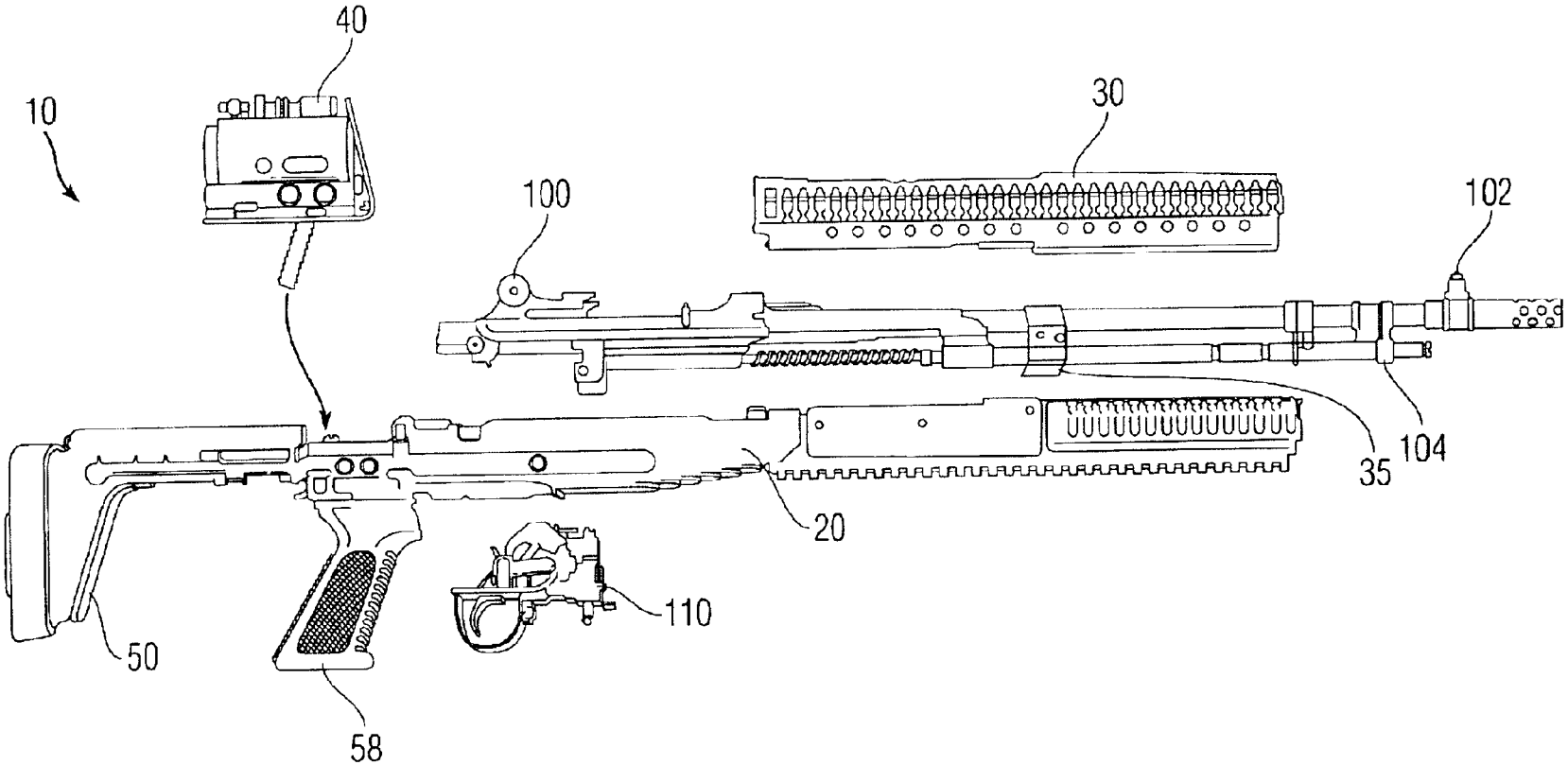
FIG. 2 is a side exploded view of a replacement chassis stock system 10 according to a preferred embodiment of the present invention inclusive of the existing reused components 100, 110 (from FIG. 1) from the existing firearm design, with components 32, 150, and 160 from the existing firearm design of FIG. 1 having been replaced.

FIG. 2 is a side exploded view of the replacement chassis stock system 10 in the context of the aforementioned M-14 rifle according to the present invention. The replacement chassis stock system 10 reuses the barreled action 100 and trigger assembly 110 from the existing firearm. However, the stock 150, top handguard 32, and operating rod guide 160 of the existing firearm design of FIG. 1 have been replaced as described below.

The modular, replacement chassis stock system 10 (for use with the existing firearm's operating mechanism including barreled action 100 and trigger assembly 110), typically comprises a chassis assembly 20, a top rail 30, a replacement operating rod guide 35, a buttstock/grip mount assembly 40 (also see FIGS. 6, 8), and a telescoping buttstock assembly 50 as will be described in more detail.

Figure 3:
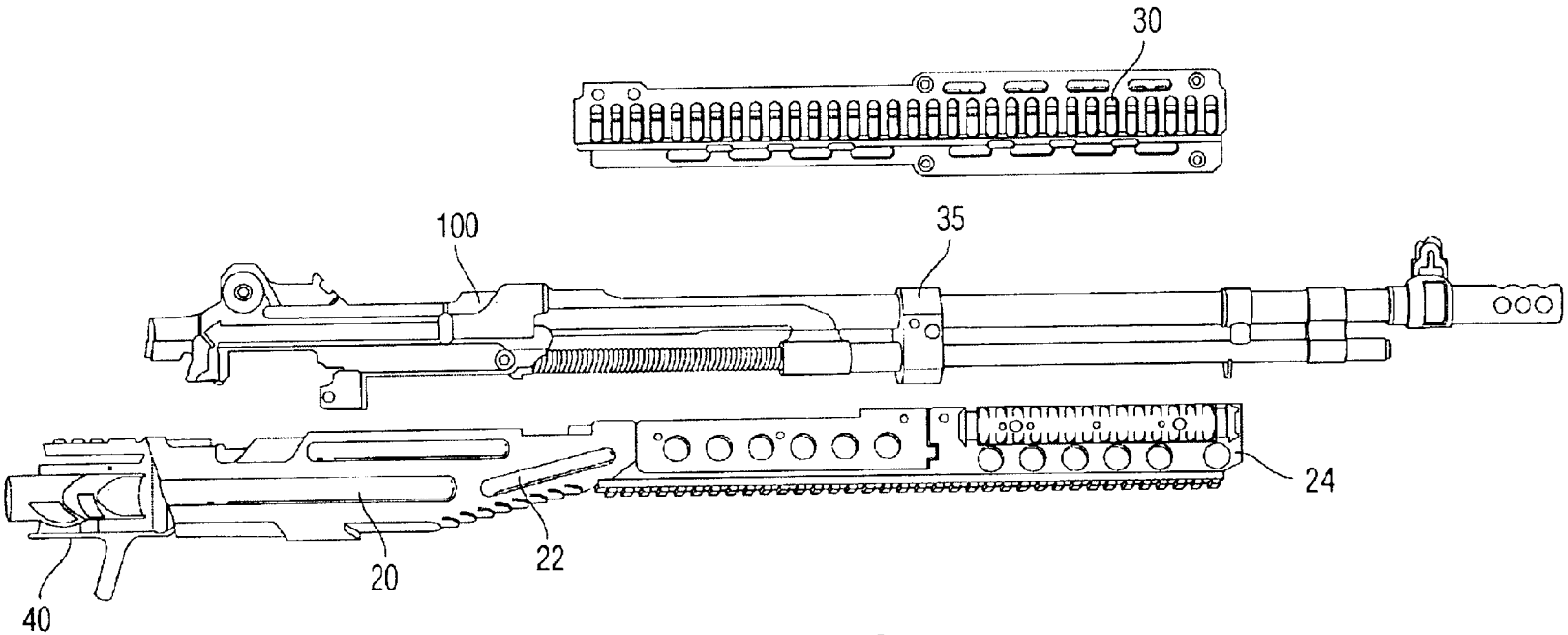
FIG. 3 is a side exploded view of a chassis assembly 20 and a top rail 30 according to a preferred embodiment of the present invention shown with the reusable barreled action 100 of an existing firearm design.

FIG. 3 is a side exploded view of the chassis assembly 20 and top rail 30 as in FIG. 2 (shown with the reusable barreled action 100 of the existing firearm design).

Figure 4:
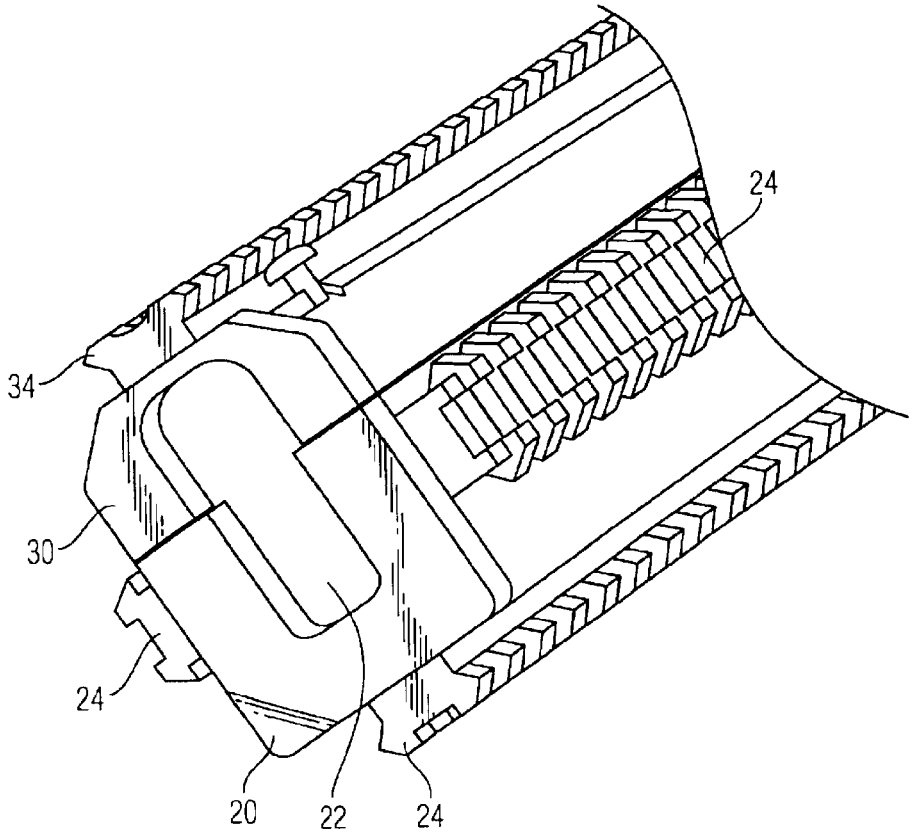
FIG. 4 is a perspective view of the front end of the replacement chassis stock system 10 of FIG. 2.

FIG. 4 is a close up perspective view of the forward ends of the chassis assembly 20 and the top rail 30 as in FIG. 3.

With collective reference to FIGS. 3 and 4, the chassis assembly 20 preferably includes a chassis 22 and up to three commercially available Mil Std 1913 pattern mounting rails 24. The mounting rails 24 are available from Sage International of Oscoda, Mich. (i.e. the current chassis stock producer), as well as various other vendors, and are fixedly attached to the chassis 22. The chassis 22 is preferably fabricated from a single block of commercially available aluminum, or other suitable material. In alternative embodiments the chassis 22 may be an assembly of two or more components (such as frame and rails embedded in composite materials).

The top rail 30 may include an optional top mounting rail 34. Top mounting rail 34 may be required or desired in addition to the three mounting rails 24, and this is possible by incorporating the optional top mounting rail 34 as an integral part of top rail 30, as shown in FIG. 4. Top mounting rail 34 may be a commercially available Mil Std 1913 pattern mounting rail (available from various suppliers) fixedly attached to the top rail 30. The top rail 30 is preferably fabricated from a single block of commercially available aluminum or other suitable material with the top mounting rail 34 integral (i.e. a single unit, not an assembly). The top rail 30, once attached to the chassis assembly 20, assists in maximizing the rigidity of the replacement chassis stock system 10. In alternative embodiments of the present invention the top rail 30 may be an assembly of two or more components.

Figure 5:
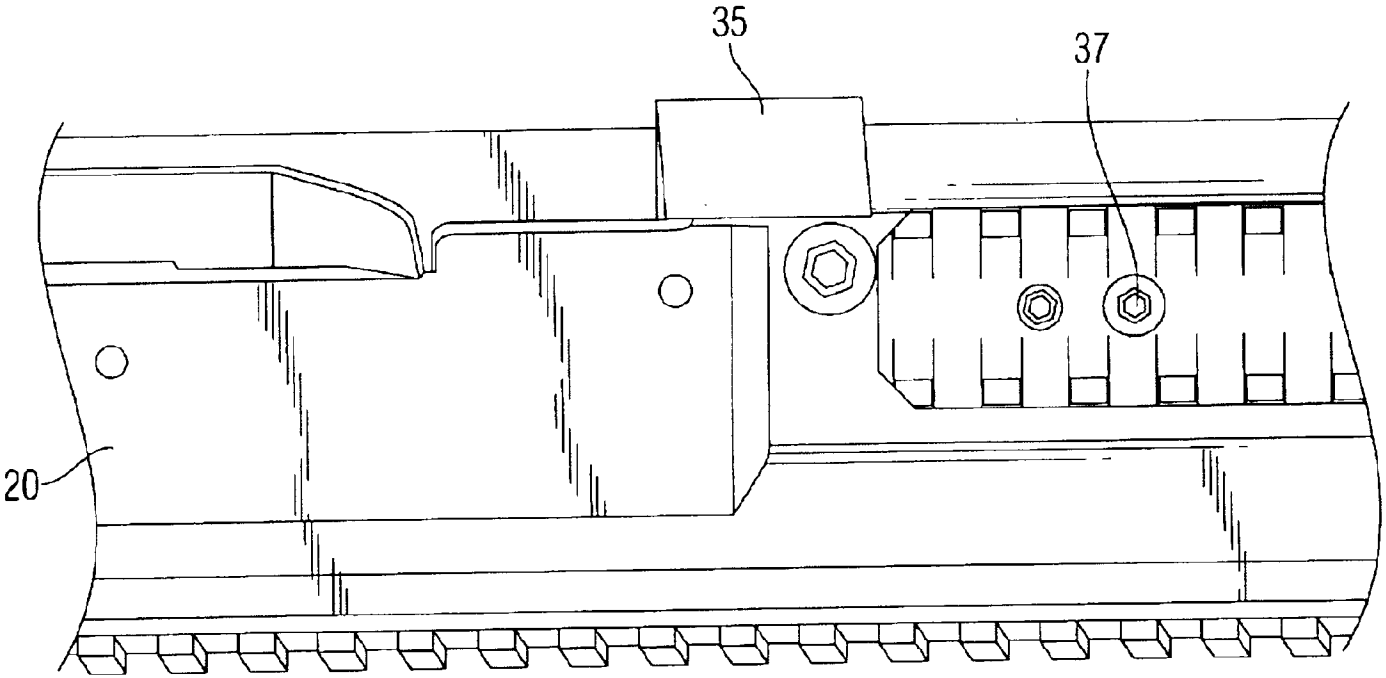
FIG. 5 is a side perspective view of the interface between a chassis assembly 20 and a replacement operating rod guide 35 according to a preferred embodiment of the present invention.

FIG. 5 provides a side perspective view of the interface between a chassis assembly 20 and a replacement operating rod guide 35 (the assembly process is discussed in detail below). The replacement operating rod guide 35 is preferably fabricated from a single block of commercially available steel alloy or other suitable material, and is designed to replace the standard operating rod guide 160 (see FIG. 1).

Figure 6:
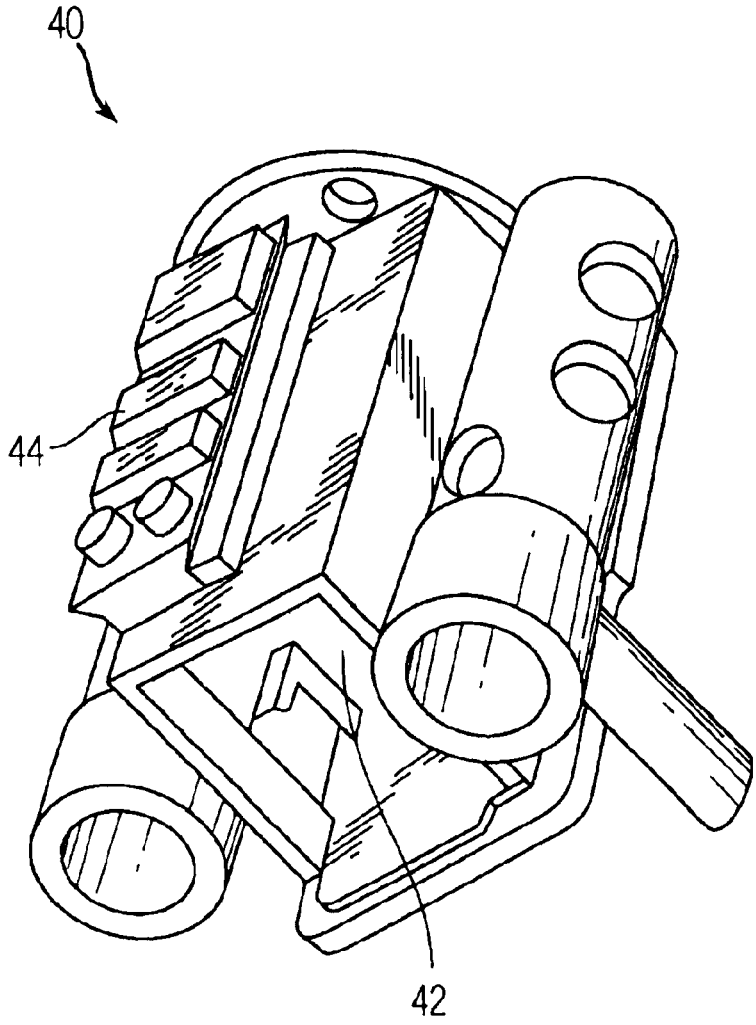
FIG. 6 is a side perspective view of a buttstock/grip mount assembly 40 according to a preferred embodiment of the present invention.

FIGS. 3 and 6 offer side perspective views of a buttstock/grip mount assembly 40 and show the manner in which yet another, optional fifth short section of mounting rail 44 may be incorporated into the chassis stock system 10. The buttstock/grip mount assembly 40 preferably includes a buttstock/grip mount base 42, and may include the optional, commercially available Mil Std 1913 pattern mounting rail 44 which may be extruded or machined integrally with the buttstock/grip mount base 42. Alternatively, the mounting rail 44 may be fixedly attached to the buttstock/grip mount base 42. In alternative embodiments of the present invention, the buttstock/grip mount base 42 may be an assembly or weldment of two or more components.

Figure 7:
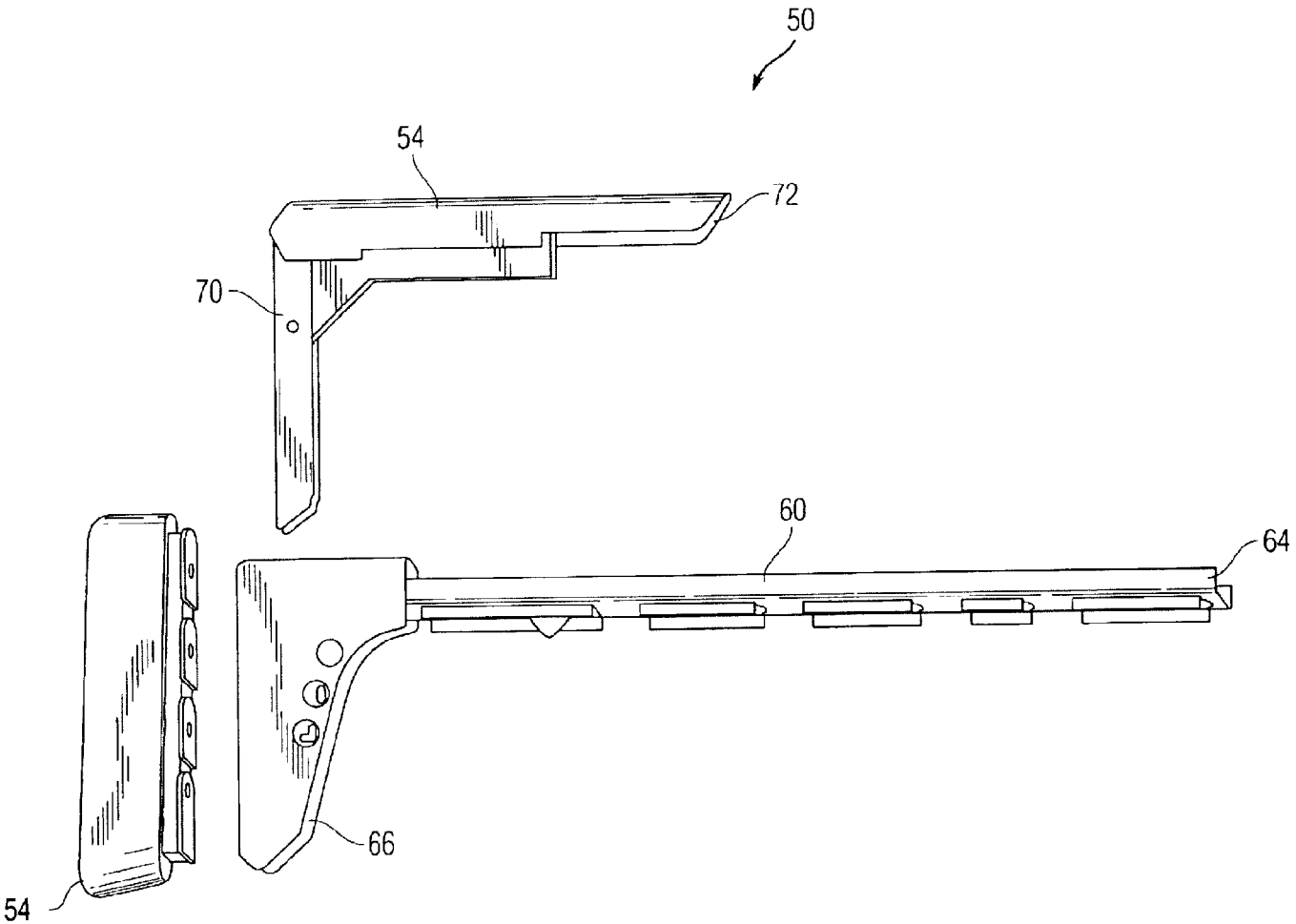
FIG. 7 is a side exploded view of a telescoping buttstock assembly 50 according to a preferred embodiment of the present invention.
Figure 8:
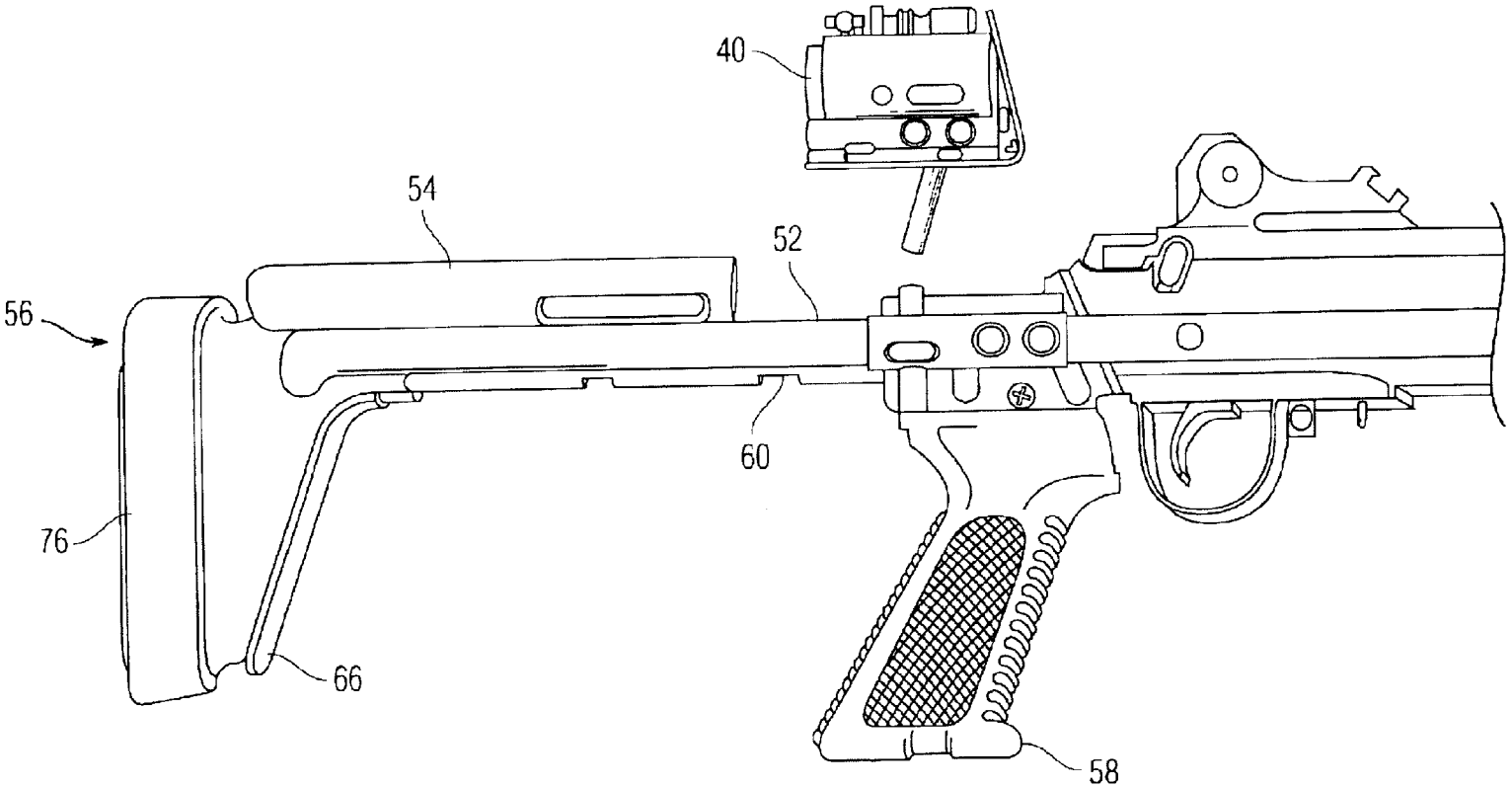
FIG. 8 is a side perspective view of the installed telescoping buttstock assembly 50 of FIG. 7 showing both installed and removed buttstock/grip mount assembly 40.

FIGS. 7 and 8 are, respectively, side exploded and side perspective views of a telescoping buttstock assembly 50 according to a preferred embodiment of the present invention. The telescoping buttstock assembly 50 is adjustable in length via the use of a thumb lever release 52 and includes an adjustable buttstock 60, an adjustable cheek rest assembly 54, and an adjustable buttpad assembly 56. A pistol grip 58 is detachably attached to the buttstock/grip mount assembly 40. The adjustable buttstock 60 preferably includes twin shafts 64 with first ends that slidably engage the buttstock/grip mount assembly 40, fixedly attached at the back end of the chassis 22 (see also FIG. 3), and second ends that are fixedly attached to a buttpad mounting block 66. The relative position between the shafts 64 and the buttstock/grip mount assembly 40 (i.e. the primary length adjustment for the buttstock assembly 50) is established by depressing the thumb lever release 52, pushing the shafts 64 further into, or pulling them out of, the buttstock/grip mount assembly 40, and then releasing the lever 52. The shafts 64 are preferably fabricated of a commercially available steel alloy while the buttpad mounting block 66 is preferably machined from a block of aluminum.

Figure 10:
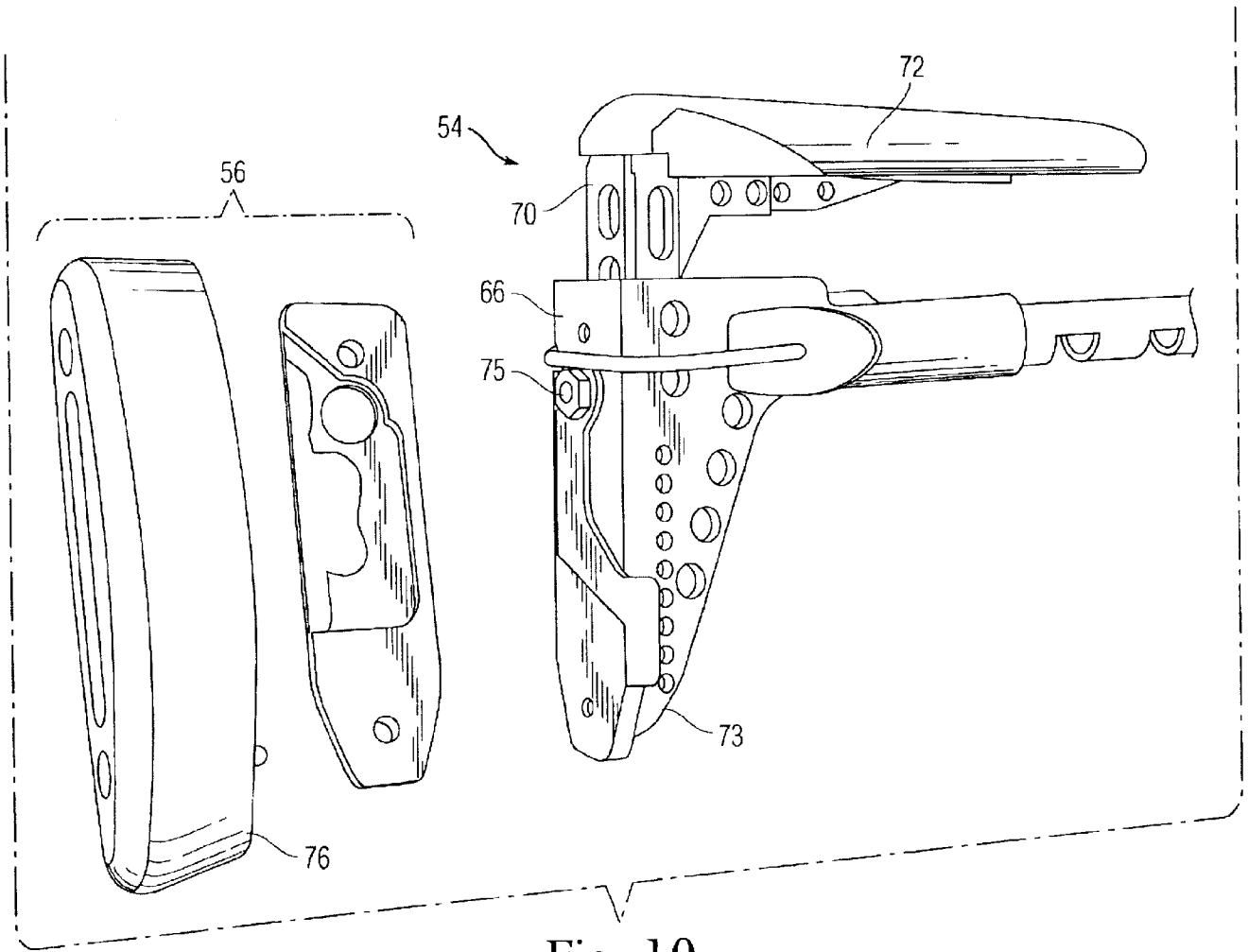
FIG. 10 is an end perspective view of an adjustable cheek rest assembly 54 according to a preferred embodiment of the present invention.

The adjustable cheek rest assembly 54, shown in detail in FIG. 10, preferably comprises an L-shaped bracket 70 and a cheek plate 72 fixedly attached to a first end of the bracket 70. A second end of the bracket 70 slidably engages the buttpad mounting block 66. The position of the of the cheek plate 72, relative to the buttpad mounting block 66, is adjusted by pivoting a lever arm 73 outward (i.e. away from the block 66) in order to rotate an adjustment screw 75 approximately 90 degrees to disengage the screw 75 from a positioning hole (not shown in the Figures) in the bracket 70, pushing the second end of the bracket 70 further into, or pulling it out of, the buttpad mounting block 66, aligning the screw 75 with another of the positioning holes in the bracket 70, and then returning the lever arm 73 and adjustment screw 75 to their original (i.e. "locked") positions. The cheek piece 72 adjusts along an axis that is perpendicular to the axis of adjustment between the shafts 64 and buttstock/grip mount assembly 40. The L-shaped bracket 70 is preferably machined from steel alloy while the cheek piece 72 is preferably a molded or machined plastic component.

The buttpad assembly 56 preferably comprises a mounting plate (obscured) and a buttpad 76 fixedly attached to a first face of the mounting plate. A second face of the mounting plate engages the buttpad mounting block 66. The position of the of the buttpad 76, relative to the buttpad mounting block 66, is currently fixed but could be made adjustable through addition of more sets of threaded holes in the buttpad mounting block 66 for attachment above or below the current setting. If made adjustable, the buttpad 76 would adjust along an axis that is perpendicular to the axis of adjustment between the shafts 64 and buttstock/grip mount assembly 40. The mounting plate is preferably machined from aluminum while the buttpad 76 is preferably a rubber component molded over the mounting plate.

Alternative embodiments of the chassis stock system 10 of the present invention may include fixed (i.e. non-adjustable) buttstock assemblies.

With reference to FIGS. 1–8, a preferred embodiment of the present invention may be used to replace the standard stock 150 of an M-14 rifle such that the barreled action 100 is held in perfect alignment with up to five Mil Std 1913 pattern mounting rails 24, 34, 44. The process of removing the standard stock 150 and replacing it with the present invention is as follows:

The trigger assembly 110 is disengaged from the barreled action 100. This provides for the separation of the barreled action 100 from the standard stock 150 and for the detachment of the top handguard 32 from the barreled action 100. The front sight/flash suppressor assembly 102 and gas cylinder 104 are removed allowing the standard operating rod guide 160 to be removed from the barreled action 100 and replaced by the replacement operating guide 35. Upon reattaching the front sight/flash suppressor assembly 102 and gas cylinder 104, the barreled action 100 is attached at the rear of the chassis assembly 20 by re-installing the trigger assembly 110 through the chassis 22, and at the front by the installation of screws 37 at the interface between the chassis assembly 20 and the replacement operating rod guide 35. After reassembly, the barreled action 100 is free floating from the replacement operating rod guide 35 forward, thereby improving the accuracy potential of the firearm.

The telescoping buttstock assembly 50 may then be added (if not already installed) by first attaching the buttstock/grip mount assembly 40 at the rear of the chassis assembly before slidably engaging the remainder of the adjustable buttstock 60 (with the adjustable cheek rest assembly 54 and adjustable buttpad assembly 56 already attached to the buttpad mounting block 66) with the buttstock/grip mount assembly 40. The pistol grip 58 may then be attached (if not already installed) to the underside of the buttstock/grip mount assembly 40.

Figure 9:
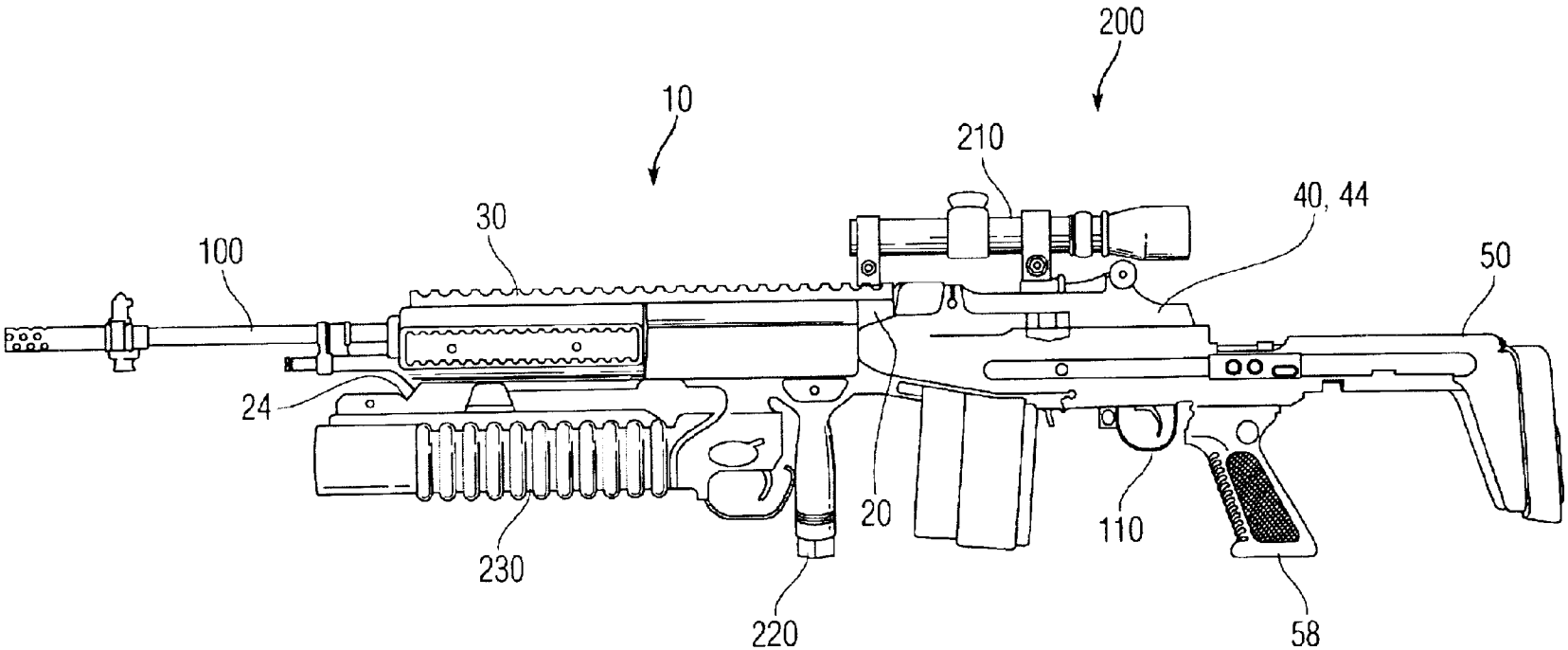
FIG. 9 is a side perspective view of a complete firearm assembly 200 incorporating the replacement chassis stock system 10 of the present invention as well as a bottom rail mounted grenade launcher 230.

FIG. 9 shows a completed firearm assembly 200 comprising the barreled action 100, the trigger assembly 110, and the replacement chassis stock system 10 of the present invention. Also shown attached to the chassis stock system 10 are a number of auxiliary items. These items include a daytime optical sight 210 attached to the Mil Std 1913 pattern mounting rail 34, and 1913 rail insert which has replaced the original stripper clip guide, and a vertical fore-grip 220 and grenade launcher 230 attached to the Mil Std 1913 pattern mounting rail 24 on the underside of the chassis assembly 20. Additional auxiliary items may include a night vision optical device, a laser targeting device, a bipod, and/or a flashlight.

The unique character of the replacement chassis stock system 10 is the manner in which the barreled action 100 is secured to the chassis assembly 20 providing its ability to maintain perfect alignment between the barrel's bore axis and any auxiliary devices attached to the Mil Std 1913 pattern mounting rails 24, 34, 44. The use of those auxiliary devices supplements the overall functionality of the firearm. Further, the standard operating rod guide 160 is replaced by a replacement operating rod guide 35 that is secured directly to the chassis assembly 20. By securing the barreled action 100 to the chassis assembly 20 via the trigger assembly 110 and the replacement operating rod guide 35 only (i.e. standard firearm designs typically include a connection between the forestock and barreled action and stock forward of all operating system components), a greater portion of the front end of barreled action 100 remains free floating, thereby providing improved accuracy potential. The ergonomics and portability of the firearm are enhanced by the inclusion of the pistol grip and the telescoping buttstock assembly 50 with its adjustable cheek rest assembly 54, and buttpad assembly 56. Finally, the replacement chassis stock system 10 of the present invention possesses a simple design that, by incorporating durable, commercially available components and materials, may be economically produced to provide for widespread use.

Alternative embodiments of the present invention may include the addition of a screw mechanism to apply pressure upward or downward on the barrel in front of the replacement operating guide 35, in an adjustable manner, for the purpose of fine tuning the firearm's shooting accuracy. Or, the barrel may be securely clamped to the chassis assembly 20 in some manner to maximize firearm durability. Moreover, application of the present invention to other similarly constructed firearm/weapon system designs may be possible.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A replacement chassis stock system for weapon systems having a barrel, comprising;

a chassis assembly;

a replacement operating rod guide detachably attached to said chassis assembly wherein said barrel remains fixedly attached to said chassis assembly while said replacement operating rod guide moves;

a top rail detachably attached to said chassis assembly;

a buttstock/grip mount assembly detachably attached to said chassis assembly;

a buttstock assembly slidably engaged with said buttstock/grip mount assembly; and a pistol grip detachably attached to said buttstock/grip mount assembly;

whereby attachment of a barreled action and a trigger assembly from an existing weapon system to said replacement chassis stock system extends the useful life of said weapon system by improving its utility, ergonomics, and firing accuracy.

2. The replacement chassis stock system according to claim 1 wherein said chassis assembly further comprises;

a chassis; and a plurality of mounting rails fixedly attached to said chassis.

3. The replacement chassis stock system according to claim 2 wherein said plurality of mounting rails further comprise a plurality of Mil Std 1913 pattern mounting rails.

4. The replacement chassis stock system according to claim 2 wherein said chassis is fabricated of aluminum.

5. The replacement chassis stock system according to claim 1 wherein said top rail further comprises;

a rail base; and a mounting rail fixedly attached to said rail base.

6. The replacement chassis stock system according to claim 5 wherein said mounting rail further comprises a Mil Std 1913 pattern mounting rail.

7. The replacement chassis stock system according to claim 5 wherein said rail base is fabricated of aluminum.

8. The replacement chassis stock system according to claim 1 wherein said buttstock/grip mount assembly further comprises;

a mounting base; and a mounting rail fixedly attached to said mounting base.

9. The replacement chassis stock system according to claim 8 wherein said mounting rail further comprises a Mil Std 1913 pattern mounting rail.

10. The replacement chassis stock system according to claim 8 wherein said mounting base is fabricated of aluminum.

11. The replacement chassis stock system according to claim 1 wherein said buttstock assembly further comprises;

an adjustable buttstock;

a release mechanism detachably attached to said buttstock/grip mount assembly and releasably engaged with said adjustable buttstock for adjusting its length;

an adjustable cheek rest assembly slidably engaged with said adjustable buttstock; and a buttpad assembly detachably attached to said adjustable buttstock.

12. The replacement chassis stock system according to claim 11 wherein said buttpad assembly further comprises;

a mounting block;

a mounting bracket detachably attached at a first end to said mounting block; and a buttpad fixedly attached to a second end of said mounting bracket.

13. The replacement chassis stock system according to claim 12 wherein said mounting block and said mounting bracket are fabricated of aluminum.

14. The replacement chassis stock system according to claim 12 wherein said adjustable buttstock further comprises two shafts with first ends that slidably engage said buttstock/grip mount assembly and second ends that are fixedly attached to said mounting block.

15. The replacement chassis stock system according to claim 14 wherein said shafts are fabricated of a steel alloy.

16. The replacement chassis stock system according to claim 12 wherein said adjustable cheek rest assembly further comprises;

an L-shaped bracket slidably engaged at a first end with said mounting block; and a cheek plate fixedly attached to a second end of said L-shaped bracket.

17. The replacement chassis stock system according to claim 16 wherein said L-shaped bracket is fabricated of aluminum.

18. The replacement chassis stock system according to claim 1 wherein said replacement operating rod guide is fabricated of a steel alloy.

19. A method for extending the useful life of an existing weapon system having a barrel by improving its utility, ergonomics, and firing accuracy, comprising the steps of;

disassembling an existing weapon system to obtain a first barreled action, a trigger assembly, and a standard stock;

disassembling said first barreled action to obtain a handguard, a front sight/flash suppressor assembly, a gas cylinder, a standard operating rod guide, and a barreled action subassembly;

discarding said standard stock, said handguard, and said standard operating guide;

attaching a replacement operating rod guide to said barreled action subassembly;

reassembling said barreled action subassembly with said replacement operating rod guide, said front sight/flash suppressor assembly, and said gas cylinder to obtain a second barreled action wherein said barrel remains fixedly attached to a chassis assembly while said replacement operating rod guide moves;

attaching said second barreled action with said replacement operating rod guide and said trigger assembly to said chassis assembly comprising a plurality of Mil Std 1913 pattern mounting rails;

attaching a top rail to said chassis assembly, said top rail comprising a Mil Std 1913 pattern mounting rail;

attaching a buttstock/grip mount assembly to said chassis assembly, said buttstock/grip mount assembly comprising a Mil Std 1913 pattern mounting rail;

attaching a buttstock assembly to said buttstock/grip mount assembly, said buttstock assembly comprising an adjustable buttstock and an adjustable cheek rest; and attaching a pistol grip to said buttstock/grip mount assembly;

whereby said plurality of Mil Std 1913 pattern mounting rails improves the utility of said existing weapon system, said adjustable buttstock and said adjustable cheek rest improve the ergonomics of said existing weapon system, and said replacement operating rod guide improves the firing accuracy of said existing weapon system.

* * * * *